US009322281B2

(12) United States Patent
Schlemmer et al.

(10) Patent No.: US 9,322,281 B2
(45) Date of Patent: Apr. 26, 2016

(54) SHROUD SEGMENT TO BE ARRANGED ON A BLADE

(75) Inventors: Markus Schlemmer, Mainburg (DE); Bartlomiej Pikul, Tarnow (PL)

(73) Assignee: MTU Aero Engines GmbH, Munich (DE)

( * ) Notice: Subject to any disclaimer, the term of this patent is extended or adjusted under 35 U.S.C. 154(b) by 681 days.

(21) Appl. No.: 13/380,481

(22) PCT Filed: Jun. 21, 2010

(86) PCT No.: PCT/DE2010/000707

§ 371 (c)(1),
(2), (4) Date: Dec. 22, 2011

(87) PCT Pub. No.: WO2009/149139

PCT Pub. Date: Dec. 29, 2010

(65) Prior Publication Data

US 2012/0107123 A1 May 3, 2012

(30) Foreign Application Priority Data

Jun. 26, 2009 (DE) ..... 10 2009 030 566

(51) Int. Cl.
*F01D 5/22* (2006.01)
*F01D 11/08* (2006.01)

(52) U.S. Cl.
CPC ..... *F01D 5/225* (2013.01); *F01D 11/08* (2013.01); *F05D 2240/307* (2013.01)

(58) Field of Classification Search
CPC ..... F01D 5/22; F01D 5/225; F01D 11/08; F01D 11/12; F01D 11/122; F01D 11/125; F01D 11/127; F01D 2240/11; F01D 2240/125; F01D 2240/307
USPC ..... 416/191, 190, 194, 195; 415/174.2
See application file for complete search history.

(56) References Cited

U.S. PATENT DOCUMENTS

| | | | |
|---|---|---|---|
| 5,531,568 | A | 7/1996 | Broadhead |
| 5,785,496 | A | 7/1998 | Tomita |
| 6,491,498 | B1 | 12/2002 | Seleski et al. |
| 2008/0025841 | A1 | 1/2008 | Norton et al. |
| 2012/0003078 | A1 * | 1/2012 | Pikul et al. ..... 415/173.1 |

FOREIGN PATENT DOCUMENTS

| | | | |
|---|---|---|---|
| DE | 10 2008 002 9 | | 2/2009 |
| EP | 1 413 712 | A1 | 4/2004 |
| EP | 1 890 008 | A2 | 2/2008 |
| GB | 2 290 833 | A | 1/1996 |
| JP | 11050806 | A * | 2/1999 |
| WO | WO 2005/008032 | A1 | 1/2005 |

OTHER PUBLICATIONS

Machine Translation of WO2005008032A1.*
Machine translation of WO2005008032A1 (Jan. 27, 2005) from Espacenet.*
Printout of google translator showing the English translation of the German words "die Masse", "minimierte", "steifigkeits", and "maximierte".*
German Search Report, dated Jun. 15, 2010, 5 pages.
PCT/DE2010/000707 PCT/ISA/210, dated May 23, 2011, 3 pages.

* cited by examiner

*Primary Examiner* — Ninh H Nguyen
*Assistant Examiner* — Christoher R Legendre
(74) *Attorney, Agent, or Firm* — Crowell & Moring LLP

(57) ABSTRACT

A shroud segment to be arranged on a gas turbine blade is disclosed. The shroud segment includes a shroud segment surface and a stiffening structure that is raised relative to the shroud segment surface. The stiffening structure is cross-shaped at least in some areas.

9 Claims, 3 Drawing Sheets

SHROUD SEGMENT TO BE ARRANGED ON A BLADE

This application claims the priority of International Application No. PCT/DE2010/000707, filed Jun. 21, 2010, and German Patent Document No. 10 2009 030 566.1, filed Jun. 26, 2009, the disclosures of which are expressly incorporated by reference herein.

BACKGROUND AND SUMMARY OF THE INVENTION

The invention relates to a shroud segment to be arranged on a blade, in particular a gas turbine blade. The invention further relates to a blade, in particular a gas turbine blade, for a turbomachine.

This type of shroud segment as well as a blade with this type of shroud segment are already known from the prior art. The shroud segment, which is arranged on a radial end area of the blade, is fundamentally used to dampen blade vibrations and is used in particular in the case of gas turbine blades for rear turbine blades. In addition, the shroud segment reduces the flow around blade tips and hereby increases the efficiency of an associated turbomachine. The shroud segments of adjacent blades of a rotor form a continuous shroud in this case. To reduce stress concentrations, known shroud segments feature a stiffening structure that is raised relative to a shroud segment surface, which is usually formed as a so-called "dog bone" or "half dog bone".

The fact that known shroud segments must be designed to be comparatively voluminous in order to make an adequate reduction in stress concentrations possible must be considered to be disadvantageous in this case. This in turn substantially increases the overall weight of the shroud segment as well as a blade provided therewith. This also leads to high masses being moved when the blade is in operation.

The object of the present invention is to create a shroud segment as well as a blade provided with such a shroud segment, which makes a weight reduction possible with simultaneously good reduction in stress.

Advantageous embodiments with expedient further developments of the invention are disclosed in the respective subordinate claims, wherein advantageous embodiments of the shroud segment are to be viewed as advantageous embodiments of the blade and vice versa.

In the case of a shroud segment according to the invention which makes a weight reduction possible with simultaneously good reduction in stress, the stiffening structure is cross-shaped at least in some areas. Because of the cross-shaped design the stress concentrations are able to be reduced significantly in the shroud segment and the stiffness of the shroud segment is improved while simultaneously optimizing weight.

An advantageous embodiment of the invention provides that the stiffening structure comprises at least two ribs arranged in a cross-shaped manner, whose principal axes are at a predetermined angle to one another. This makes a simple and targeted adjustment of the stress level within the shroud segment possible, wherein different shroud segment types may be taken into consideration individually. In this case, it may be provided for example that the respective angle be determined as a function of the respective shroud segment geometry, the shroud segment material and the subsequent use conditions in an associated turbomachine.

In another embodiment, it has been shown to be advantageous if the principal axes of the ribs are at an angle of between 20° and 90° to one another. An especially advantageous stress distribution is hereby ensured within the shroud segment with simultaneously high stiffness.

Additional advantages are produced in that the stiffening structure comprises at least one rib, which is arranged along and/or perpendicular to a stress line of the shroud segment. Because of the stiffness that is hereby obtained in the shroud segment, an especially low stress level is achieved within the shroud segment.

Another embodiment of the invention provides that the stiffening structure comprises at least one rib, which has a constant or location-dependent height over its longitudinal extension in the profile. In other words, it is provided that one or more ribs of the stiffening structure has a uniform and/or a varying height profile over its longitudinal extension, which results in an especially precise adaptability of the stiffening structure to the respective design of the shroud segment and the individual progression of the stress lines within the shroud segment.

An optimum adaptability of the shroud segment with respect to minimum weight with a maximum reduction in stress is made possible in another advantageous embodiment of the invention in that the at least one rib has a height between 0.1 cm and 10 cm.

In this case, it has furthermore been shown to be advantageous if the stiffening structure comprises at least one rib, which has a cross-sectional profile over its longitudinal extension is selected as a function of a stress profile of the shroud segment without this rib. In other words, the cross-sectional profile of the at least one rib is formed over its longitudinal extension while taking a stress profile into consideration which the shroud segment would have without this rib. For example, the at least one rib may have a thickened cross-sectional profile in regions of potentially high stress. Conversely, a correspondingly reduced cross-sectional profile may be provided in regions with potentially low stress. As a result, a maximum reduction in stress can be produced with minimal additional weight of the shroud segment.

An increase in the shroud segment's fatigue strength is made possible in another embodiment in that the stiffening structure comprises rounded surface transitions to the shroud segment surface, because this permits the occurrence of peaks in force on the edges of the stiffening structure to be reliably prevented for example in the case of tensile or bending loads of the shroud segment.

An especially high level of stiffness of the shroud segment with optimized weight is achieved in another embodiment in that the stiffening structure laterally delimits at least one discrete shroud segment surface region. In other words the shroud segment has a depression, which is formed by the raised stiffening structure.

An especially uniform distribution of force and stress over the shroud segment is achieved in another embodiment in that the stiffening structure laterally delimits four and/or six discrete shroud segment surface regions.

Another advantageous embodiment of the invention provides that the shroud segment has two opposing contact surfaces that are essentially Z-shaped in the longitudinal section for application to corresponding contact surfaces of two other shroud segments. As a result, adjacent blades, each of which are provided with such a shroud segment, are supported on each other in pairs during the operation of an associated turbomachine or a rotor provided with these blades, thereby making an especially mechanically stable shroud possible. Undesired bending or twisting of the blades is likewise minimized through this.

An especially high level of stiffness is achieved in a further embodiment in that the stiffening structure comprises at least one rib, which extends between the two contact surfaces. As a result, it is possible to provide that the rib extends between corresponding corner regions of the two Z-shaped contact surfaces, because generally great stress concentrations may occur at these corners.

A further aspect of the invention relates to a blade, in particular a gas turbine blade, for a turbomachine, comprising a shroud segment arranged on a radial end area of the blade, which has a stiffening structure that is raised relative to a shroud segment surface. A reduction in the weight of the blade with simultaneously good reduction in stress is achieved according to the invention in that the stiffening structure is cross-shaped at least in some areas. Because of the cross-shaped design, the stress concentration in the shroud segment may be reduced significantly and the stiffness of the shroud segment is improved with simultaneous weight optimization.

It has been shown to be advantageous in this case if the shroud segment is designed according to one of the preceding exemplary embodiments. The advantages that are produced in the process can be found in the corresponding descriptions.

An especially high level of mechanical stability and loading capacity of the blade is achieved in another embodiment in that the shroud segment is designed to be one piece with the blade. Although the shroud segment and the blade may fundamentally also be designed to be two-piece or multi-piece and may be joined in a suitable manner, a one-piece design also allows the assembly step that would otherwise be required to be dispensed with, thereby resulting in corresponding cost reductions.

Another aspect of the invention relates to a turbomachine, in particular thermal gas turbines, having a rotor, which comprises at least one blade with a shroud segment arranged on the radial end area of the blade, wherein the shroud segment has a stiffening structure that is raised relative to a shroud segment surface. In this case, a weight reduction of the at least one blade is achieved with a simultaneously good reduction in stress in that the shroud segment and/or the blade are designed according to one of the preceding exemplary embodiments. As a result, the weight of the rotor or the entire turbomachine is correspondingly optimized with a simultaneous improvement in its loading capacity, thereby making it possible to realize extended maintenance cycles. All shroud segments and/or blades of the rotor are preferably designed according to one of the preceding exemplary embodiments in order to achieve a maximum reduction in weight and stress. In addition, the masses being moved during operation of the turbomachine are correspondingly reduced, thereby producing additional advantages in particular with respect to fuel savings. Additional features of the invention are yielded from the claims, the exemplary embodiments as well as on the basis of the drawings. The features and combinations of features cited above in the description as well as the features and combinations of features cited subsequently in the exemplary embodiments are not just usable in the respective cited combination, but also in other combinations or alone without leaving the scope of the invention.

DETAILED DESCRIPTION OF THE DRAWINGS

Figure 1:
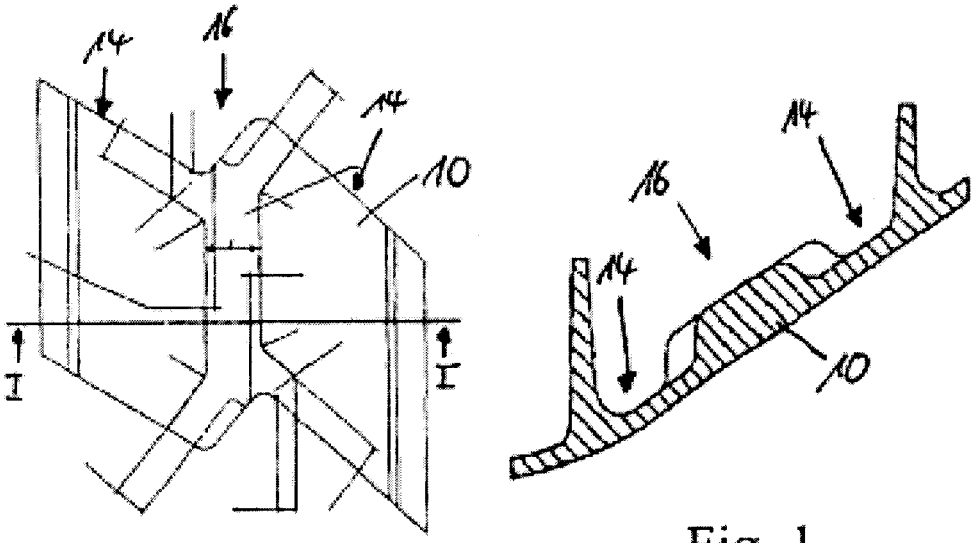
Fig. 1 (Prior Art)
FIG. 1 is a schematic view and a lateral sectional view of a shroud segment known from the prior art with a stiffening structure.

FIG. 1 shows a schematic view of a shroud segment 10 known from the prior art to be arranged on a blade 12 (see FIG. 3) as well as a lateral sectional view of the shroud segment 10 along the intersection line I-I. The shroud segment 10 features a stiffening structure 16 that is raised relative to a shroud segment surface 14, which, as the view shows, is essentially designed to be bone-shaped and is therefore referred to as a "dog bone".

Figure 2:
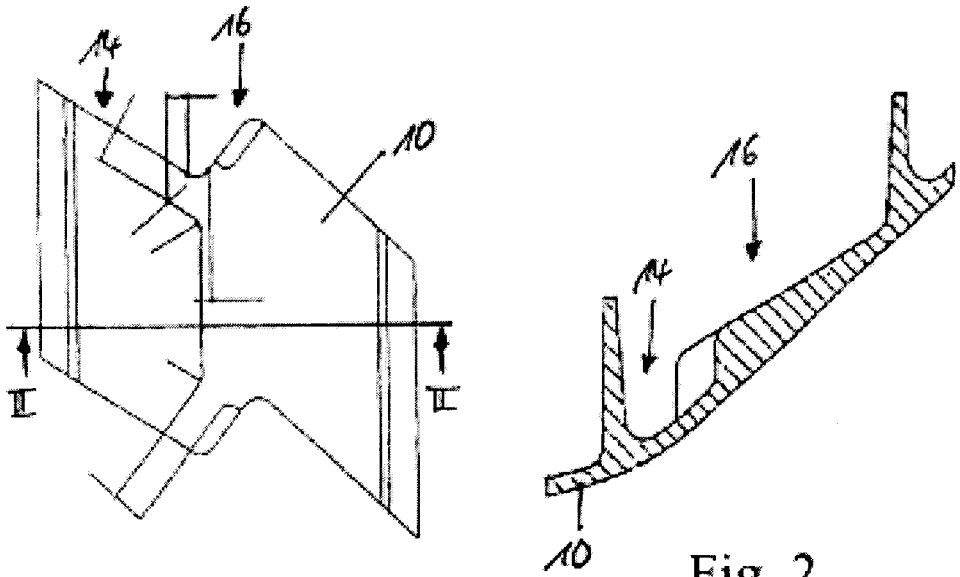
Fig. 2 (Prior Art)
FIG. 2 is a schematic view and a lateral sectional view of a shroud segment known from the prior art with an alternative stiffening structure.

FIG. 2 shows a schematic view of a shroud segment 10 known from the prior art to be arranged on a blade 12 (see FIG. 3) as well as a lateral sectional view of the shroud segment 10 along the intersection line II-II. The shroud segment 10 features an alternative stiffening structure 16 as compared to the shroud segment 10 in FIG. 1, which is flattened towards one side and is therefore referred to as a "half dog bone".

The disadvantage of the two shroud segments depicted in FIG. 1 and FIG. 2 is that their stiffening structures 16 must be designed to be comparatively voluminous in order to be able to guarantee an adequate reduction in the stress concentrations in the shroud segment 10. The weight of the shroud segments 10 as well as a blade 12 connected to this type of a shroud segment 10 is hereby increased.

Figure 3:
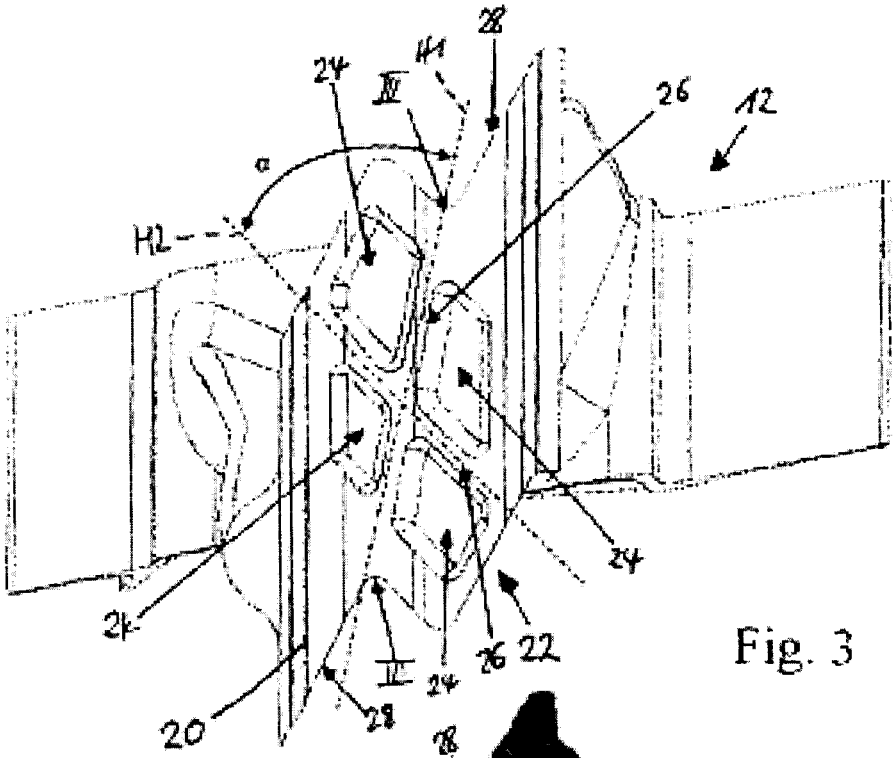
FIG. 3 is a schematic perspective view of a blade with a shroud segment according to the invention, which has a stiffening structure according to a first exemplary embodiment.

FIG. 3 shows a schematic perspective view of a blade 12 designed as a gas turbine blade for a turbomachine with a shroud segment 20 according to the invention, which has a stiffening structure 22 according to a first exemplary embodiment. The stiffening structure 22 is likewise designed to be raised relative to a shroud segment surface 24 of the shroud segment 20, however, in contrast to the embodiments depicted in FIGS. 1 and 2, it is cross-shaped is some areas. Because of the cross-shaped design, the stress concentration in the shroud segment 20 may be reduced significantly and the stiffness of the shroud segment 20 may be substantially improved with simultaneous weight optimization. In the present case, the stiffening structure 22 comprises two ribs 26 arranged in a cross-shaped manner, whose principal axes H1, H2 are at a predetermined angle $\alpha$ to one another and which have a constant height over their longitudinal extension in the profile. In addition, the two ribs 26 are arranged along or perpendicular to stress lines of the shroud segment 20. This achieves an especially efficient reduction of the stress level of the shroud segment 20. Because of the height of the ribs 26 and of the angle $\alpha$ between the principal axes H1, H2 of the ribs 26, it is possible to adjust the stress level exactly. The angle $\alpha$ and the course of the profile of the ribs 26, in particular their height, must be determined in this case individually for every shroud segment type as a function of the respective stress lines which would occur without the stiffening structure 22.

The shroud segment 20 also has two opposing contact surfaces 28 (Z shroud) that are essentially Z-shaped in the longitudinal section for application to corresponding contact surfaces of two other shroud segments (not shown). One of the ribs 26 in this case extends between corners III of the two Z-shaped contact surfaces 28, thereby achieving an especially great reduction in stress in regions of the shroud segment 20 that are otherwise subjected to a lot of stress.

In addition to the ribs 26, the stiffening structure 22 is designed such that it laterally delimits four discrete shroud segment surface regions 24. In other words, the shroud segment surface regions 24 form the base surfaces of four depressions, while the stiffening structure 22 and its ribs 26 form the side walls of the depressions.

The stiffening structure 22 may basically be produced by separating methods from a shroud segment blank. Alternatively, the shroud segment 20 may also be produced, where applicable as one piece with a blade 12, with the aid of casting methods, in particular precise casting methods or generative processes.

Figure 4:
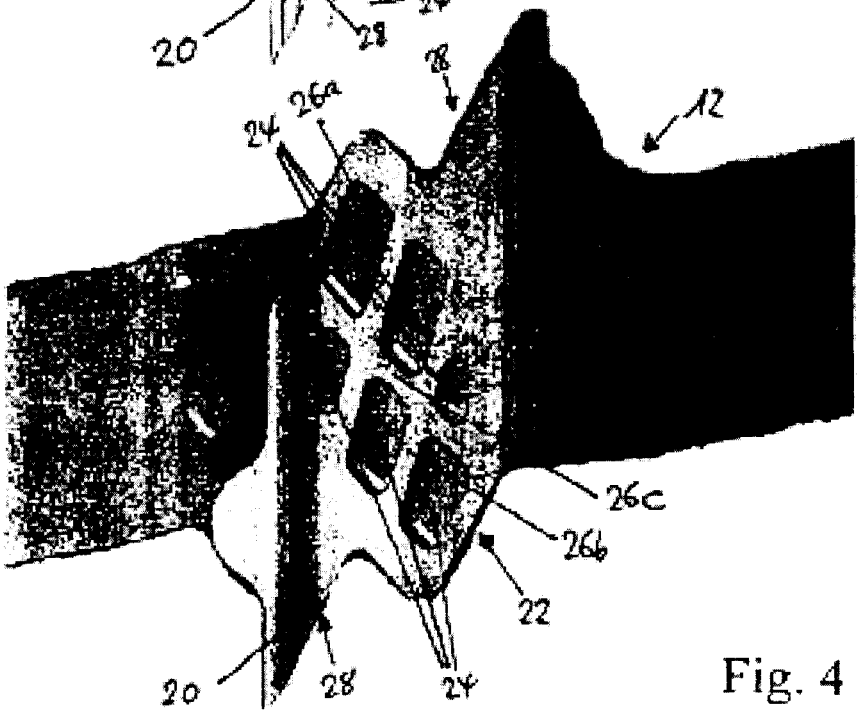
FIG. 4 is a schematic perspective view of a blade with a shroud segment according to the invention, which has a stiffening structure according to a second exemplary embodiment.
Figure 5:
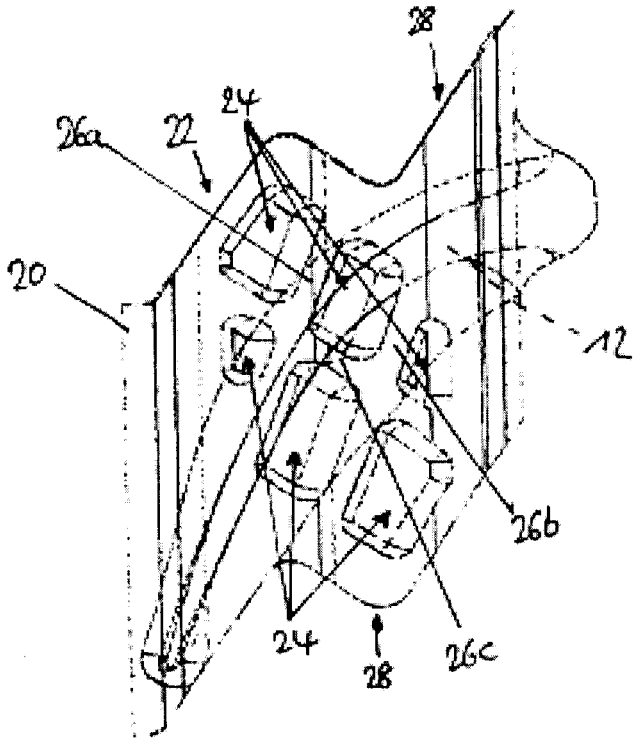
FIG. 5 is a schematic, sectional and transparent perspective view of the blade depicted in FIG. 4.

FIG. 4 shows a schematic perspective view of a blade 12 with a shroud segment 20 according to the invention, which has a stiffening structure 22 according to second exemplary embodiment. FIG. 4 shall be explained in the following together with FIG. 5, which shows a schematic, sectional and transparent perspective view of the blade 12 depicted in FIG. 4. In contrast to the exemplary embodiment shown in FIG. 3 the stiffening structure 22 comprises three ribs 26*a-c*, which are respectively arranged in pairs in a cross-shaped manner and likewise run along or perpendicular to stress lines of the shroud segment 20. The angle α between the principal axis H (not shown) of the rib 26*c* and the principal axis H of the rib 26*a* as well as the angle α between the principal axis H of the rib 26*c* and the principal axis H of the rib 26*b* are selected in the present case to be equal so that the principal axes H of the ribs 26*a*, 26*b* run parallel to one another. Due to the additional rib 26*b*, the stiffening structure 22 now laterally delimits six discrete shroud segment surface regions 24.

Figure 6:
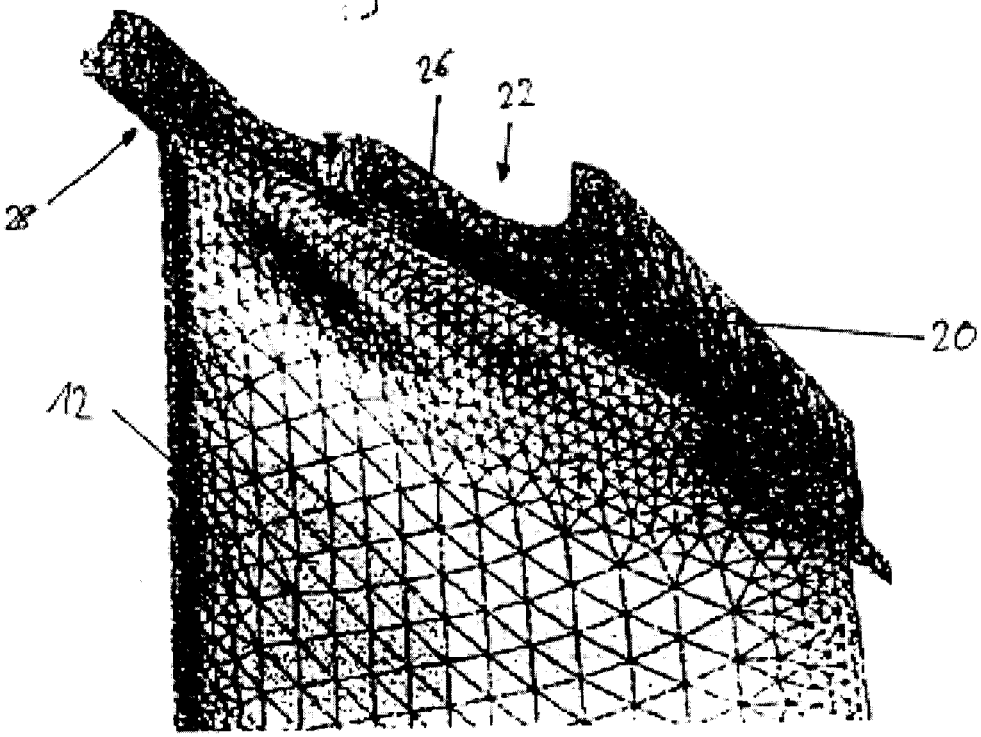
FIG. 6 is a schematic and sectional wire grid view of a rear side of a blade according to the invention with a shroud segment, which has a stiffening structure according to a third exemplary embodiment.

Finally, FIG. 6 shows a schematic and sectional wire grid view of a rear side of a blade 12 according to the invention, which is designed to be one piece with a shroud segment 20. For its part, the shroud segment 20 has a stiffening structure 22 according to a third exemplary embodiment. As in the first embodiment, the stiffening structure 22 comprises two ribs 26 arranged in a cross-shaped manner. The ribs 26 are also arranged along or perpendicular to stress lines of the shroud segment 20, wherein only one of the ribs 26 is visible. The angle α between the principal axes H of the ribs 26 as well as the height or the course of the profile of the ribs 26 is in turn selected as a function of the stress level of the shroud segment without these ribs 26.

The parameter values given in the documents for defining processing and measuring conditions for characterizing specific properties of the subject of the invention should be viewed as included in the scope of the invention also within the framework of deviations, e.g. based on measuring errors, system errors, weighing errors, DIN tolerances and the like.

The invention claimed is:

1. A turbomachine, comprising:

a rotor, including:

a blade; and a shroud segment disposed on a radial end area of the rotor blade, wherein the shroud segment includes:

a shroud segment surface;

two opposing contact surfaces that are essentially Z-shaped in a longitudinal section; and a stiffening structure that is raised relative to the shroud segment surface, wherein the stiffening structure includes at least two ribs arranged in a cross-shaped manner, wherein at least one of the at least two ribs has a varying height profile over a longitudinal extension of the at least one of the at least two ribs, and wherein at least one of the at least two ribs extends between respective corners of the two Z-shaped contact surfaces such that a reduction in stress results at the respective corners.

2. A gas turbine blade arrangement for a turbomachine, comprising:

a rotor blade; and a shroud segment disposed on a radial end area of the rotor blade, wherein the shroud segment includes:

a shroud segment surface;

two opposing contact surfaces that are essentially Z-shaped in a longitudinal section; and a stiffening structure that is raised relative to the shroud segment surface, wherein the stiffening structure includes at least two ribs arranged in a cross-shaped manner, wherein at least one of the at least two ribs has a varying height profile over a longitudinal extension of the at least one of the at least two ribs, and wherein at least one of the at least two ribs extends between respective corners of the two Z-shaped contact surfaces such that a reduction in stress results at the respective corners.

3. The gas turbine blade arrangement according to claim 2, wherein a principal axis of one of the at least two ribs is disposed at a predetermined angle to a principle axis of an other of the at least two ribs.

4. The gas turbine blade arrangement according to claim 3, wherein the predetermined angle is between 20° and 90°.

5. The gas turbine blade arrangement according to claim 2, wherein the height is between 0.1 cm and 10 cm.

6. The gas turbine blade arrangement according to claim 2, wherein the stiffening structure includes a rounded surface transition to the shroud segment surface.

7. The gas turbine blade arrangement according to claim 2, wherein the stiffening structure laterally delimits at least one discrete shroud segment surface region.

8. The gas turbine blade arrangement according to claim 2, wherein the stiffening structure laterally delimits four discrete shroud segment surface regions.

9. The gas turbine blade arrangement according to claim 2, wherein the shroud segment is formed in one piece with the rotor blade.

* * * * *